US006257398B1

(12) United States Patent
Lindars

(10) Patent No.: US 6,257,398 B1
(45) Date of Patent: Jul. 10, 2001

(54) HEADGEAR PACKAGING SYSTEM

(75) Inventor: Michael T. Lindars, San Diego, CA (US)

(73) Assignee: Troxel Cycling & Fitness LLC, San Diego, CA (US)

( * ) Notice: Subject to any disclaimer, the term of this patent is extended or adjusted under 35 U.S.C. 154(b) by 0 days.

(21) Appl. No.: 09/435,169

(22) Filed: Nov. 5, 1999

(51) Int. Cl.[7] ..... A45C 11/02; B65D 85/18
(52) U.S. Cl. ..... 206/8; 206/278
(58) Field of Search ..... 206/278, 8, 9

(56) References Cited

FOREIGN PATENT DOCUMENTS

401127 * 12/1990 (EP) ..... 206/8

* cited by examiner

*Primary Examiner*—Sue A. Weaver
(74) *Attorney, Agent, or Firm*—Walter W. Duft

(57) ABSTRACT

A headgear packaging system is disclosed for point-of-purchase display of headgear. The headgear packaging system is removably mounted to the headgear and configured to allow the headgear to be fitted to a wearer's head without removal of the packaging system from the headgear. In a preferred implementation, the headgear packaging system includes a headgear engagement portion for engaging the headgear, an opening portion allowing substantially unhindered access to the headgear interior, and a lip portion connected to the engagement portion for receiving display graphics and optionally mounting the headgear packaging system and headgear for display.

23 Claims, 2 Drawing Sheets

HEADGEAR PACKAGING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to protective headgear, and particularly helmets. More specifically, the invention is directed to a packaging system for presenting headgear for point-of-purchase display at a store or other sales outlet.

2. Description of the Prior Art

There are many types of protective headgear which are presently offered for a variety of recreational activities and work-related uses. The packaging normally used for point-of-purchase display of such items is an ordinary cardboard box with a flap opening on one side to allow access to the product. There are some variations, such as sleeves with slide-out trays to hold the product, but these alternatives still utilize a cardboard enclosure for the product.

There are several disadvantages associated with box-style packaging arrangements. First, a box requires considerable retail shelf space, which is often limited in busy sales outlets. Second, boxes do not survive well on retail shelves as customers remove the helmets from the boxes to inspect them. Third, in order to be effective, a headgear must properly fit the wearer. It is therefore important that a prospective headgear wearer be allowed to try on the prospective item before accepting it. A box makes it inconvenient for a customer to try on the product, as he or she must take the item out of the box and then try to get it back inside the box properly. This may lead some customers to purchase without actually verifying that the headgear fits correctly.

Accordingly, it would be desirable to provide a headgear packaging system that overcomes the foregoing disadvantages. What is required is a headgear packaging system that maximizes shelf space availability, withstands handling by multiple customers, and allows the customer to easily try on the headgear prior to purchase.

BRIEF SUMMARY OF THE INVENTION

In accordance with the invention, a headgear packaging system is provided for point-of-purchase display of headgear. The headgear packaging system is removably mounted to the headgear and configured to allow the headgear to be fitted to a wearer's head without removal of the packaging system from the headgear. In a preferred embodiment of the invention, the headgear packaging system includes a headgear engagement portion for engaging the headgear, an opening portion allowing substantially unhindered access to the headgear interior, and a lip portion connected to the engagement portion.

In the preferred embodiment of the invention, the headgear engagement portion is preferably a headgear engagement element such as a continuous or intermittent trough that engages a lower rim portion of the headgear. The trough includes a base wall, an inner wall and an outer wall. The base wall engages the headgear lower rim. The inner wall terminates generally proximate to the headgear lower rim and defines the opening in the headgear packaging system. The outer wall, the inner wall, or both, may be formed with a slight backdraft to exert a gripping force on the headgear. Preferably, at least the outer wall has a backdraft and extends sufficiently distally from the headgear lower rim so that the headgear packaging system remains adequately secured to the headgear prior to purchase and use. Typically, the headgear will include an outer shell mounted on an inner liner. In that case, the trough outer wall may terminate generally proximate to the lower edge of the outer shell. The lip portion of the packaging system may extend continuously around the headgear, or it may be of lesser extent. In either case, part of the lip portion is preferably widened adjacent to one side of the headgear, e.g., at the front of the headgear, to receive display graphics and possibly a cavity for holding printed materials, sizing pads, and/or other items relating to the headgear. This same area (or some other part of the lip portion), may be formed with an aperture to allow the headgear to be mounted on a display peg.

BRIEF DESCRIPTION OF THE SEVERAL VIEWS OF THE DRAWING

The foregoing and other features and advantages of the present invention will be apparent from the following more particular description of a preferred embodiment of the invention, as illustrated in the accompanying Drawing, in which.

DETAILED DESCRIPTION OF THE INVENTION

Figure 1:
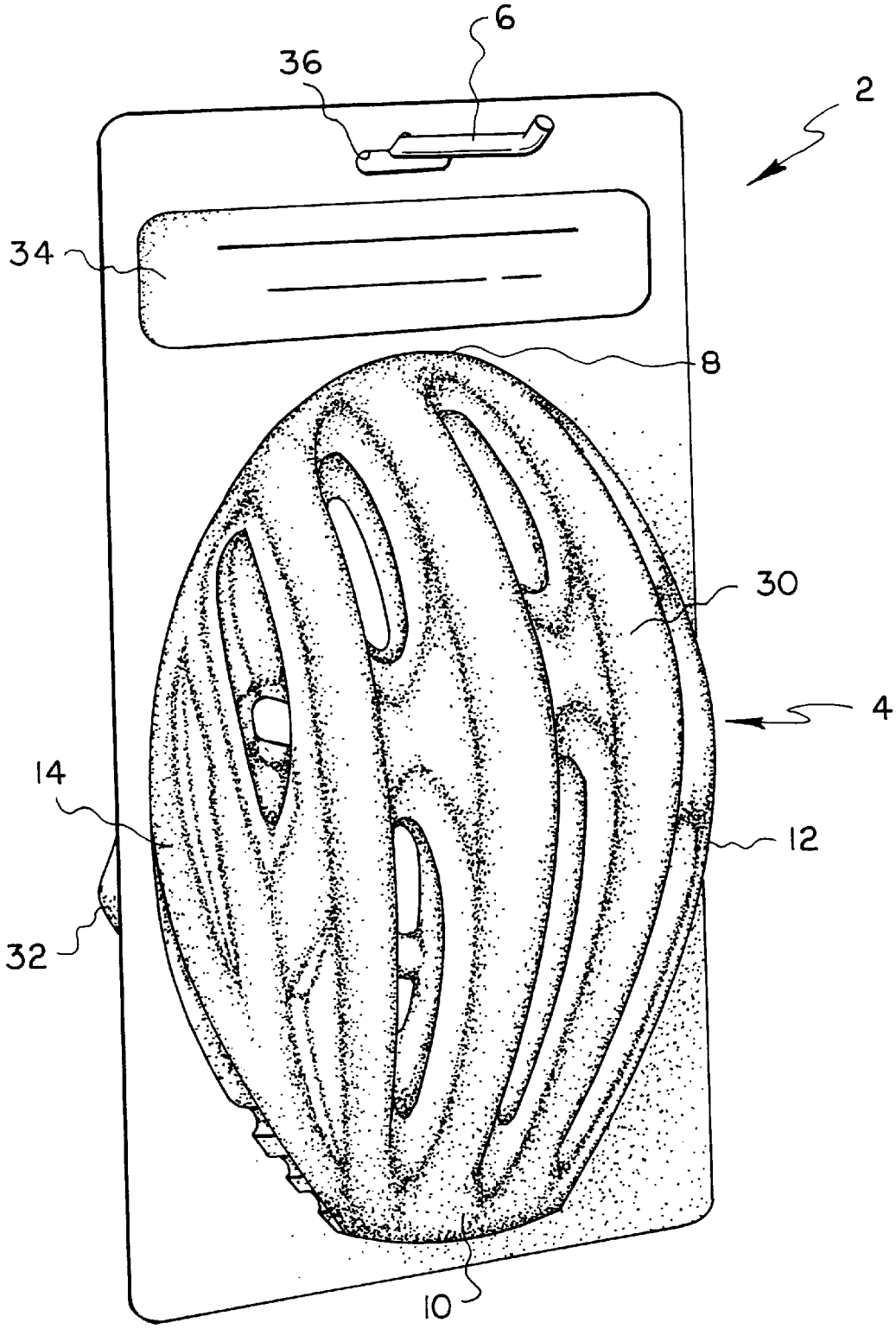
FIG. 1 is a perspective view of the front side of a headgear packaging system constructed in accordance with the present invention, with the packaging system supporting a headgear for point-of-purchase display.
Figure 3:
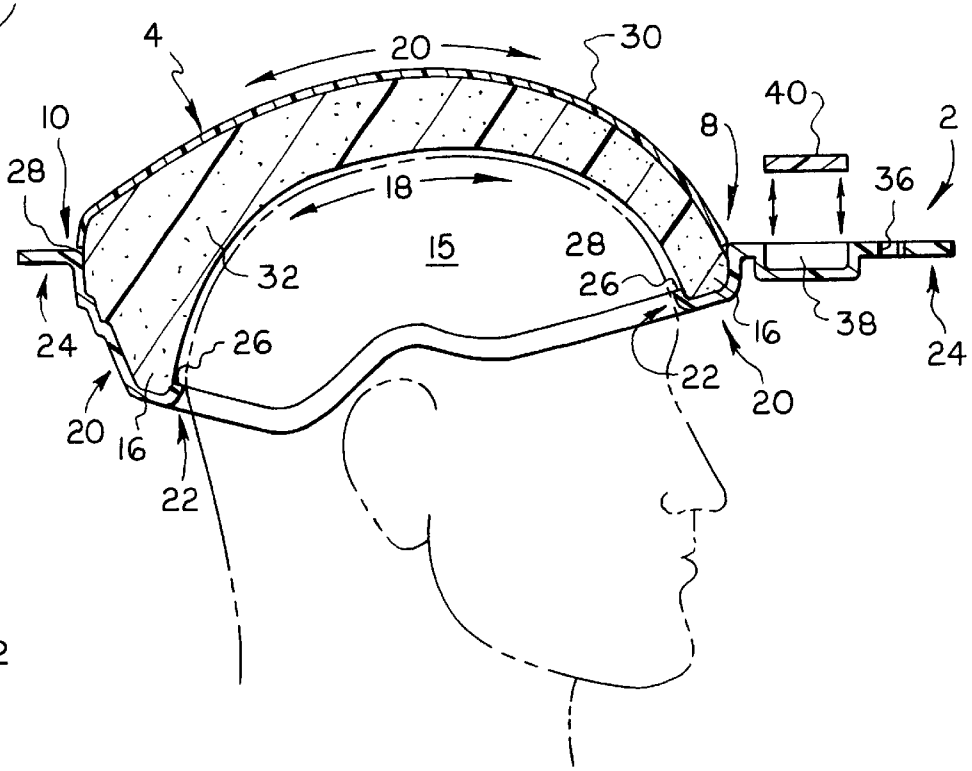
FIG. 3 is a cross-sectional view the headgear packaging system and helmet combination of FIG. 1 taken along line 3—3 in FIG. 2.
Figure 2:
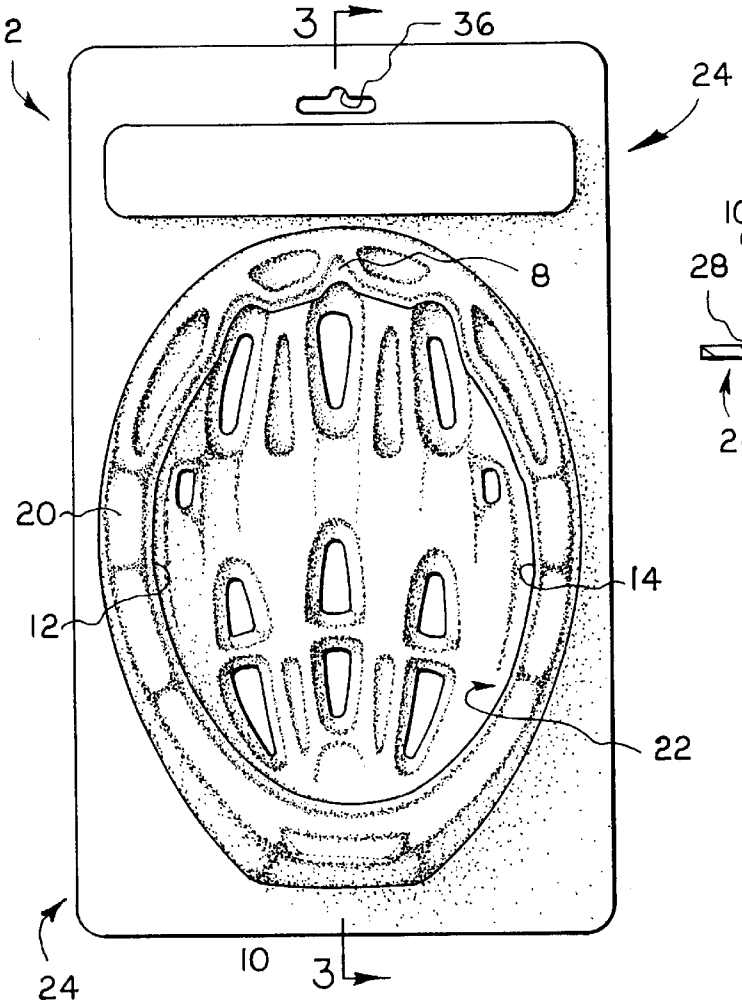
FIG. 2 is an elevated rear view of the headgear packaging system and headgear combination of FIG. 1, showing the back side of the packaging system and the interior of the headgear.

Turning now to the Drawing, wherein like reference numbers designate like elements in all of the several views, FIGS. 1–3 illustrate a headgear packaging system 2 (referred to hereinafter as "packaging system") constructed in accordance with a preferred embodiment of the invention for packaging a protective headgear 4 (referred to hereinafter as "headgear"), such as a bicycle helmet. Other helmet types could also be used insofar as the design concepts underlying the packaging system 2 are not limited to bicycle helmets alone, and are applicable a wide variety of headgear designed for virtually any recreational or work-related activity wherein protective head coverings are used.

FIG. 1 illustrates the packaging system 2 in one possible point-of-purchase display configuration wherein the headgear 4 is mounted on a display peg 6. As shown therein, and as further illustrated in FIG. 2, the headgear 4 has a forward portion shown generally at 8, a rearward portion shown generally at 10, a pair of lateral portions shown generally at 12 and 14. FIG. 3 illustrates the headgear 4, with the packaging system 2 still attached, mounted on the head 15 of a wearer who is trying on the headgear 4 for fit. As further shown in FIG. 3, the headgear 4 also includes a lower rim shown generally at 16, a headgear interior shown generally at 18, and a headgear exterior shown generally at 19.

The packaging system 2 is constructed so that it can be removably mounted to the headgear. It is configured so as to allow the headgear to be fitted to a wearer's head without removal of the packaging system 2 from the headgear 4. This functionality can be implemented in a variety of ways. In the preferred embodiment disclosed herein, the packaging system 2 includes a headgear engagement portion 20 for engaging the headgear 4, an opening portion 22 allowing substantially unhindered access to the interior 18 of the headgear 4, and a lip portion 24 that is connected to the engagement portion 20 (see FIGS. 2 and 3).

The headgear engagement portion 20 can be constructed in a variety of ways for engaging the headgear 2 at a variety of locations. Most preferably, the headgear engagement portion 20 is a single member or multi-member engaging element that engages the headgear lower rim 16. Most preferably, the headgear engagement portion 20 is a continuous trough that engages adjacent portions of the headgear lower rim 16. In a multi-member configuration of the headgear engagement portion 20 (not shown), a non continuous (i.e., intermittent) trough, a plurality of fingers or engagement tabs (i.e., two or more), or other cooperating multi-component means, could be used to engage the headgear 4, and preferably adjacent portions of the lower rim 16.

In a continuous (or intermittent ) trough configuration of the headgear engagement portion 20, the trough can be defined by a base wall 25, an inner wall 26, and an outer wall 28. The base wall 25 engages the headgear lower rim 16. The inner wall 26 terminates generally proximate to the headgear lower rim 16 and defines the opening 22 in the headgear packaging system 2. The outer wall 28, the inner wall 26, or both, may be formed with a slight backdraft (as shown at 29 in FIG. 3) to exert a gripping force on the headgear. Preferably, at least the outer wall 28 has a backdraft and extends sufficiently distally from the headgear lower rim 16 so that the headgear packaging system 2 remains adequately secured to the headgear 4 prior to purchase and use. Typically, the headgear 4, when configured as a bicycle helmet, will include a hard plastic outer shell 30 mounted on an inner EPS liner 32 (see FIG. 3). In that case, the trough outer wall 28 preferably terminates generally proximate to the lower edge of the outer shell, which conventionally extends to a mold parting line (not shown) formed on the liner 32.

The lip portion 24 of the packaging system 2 is preferably connected to the headgear engagement portion 20 so as to extend outwardly away from the headgear 4. The lip portion 24 may extend continuously around the headgear 4, or it may be of lesser extent. In either configuration, the lip portion 24 is preferably wide enough adjacent to one side of the headgear 4 (e.g., at the front portion 8) to receive display graphics 34 relating to the headgear 4. This can be seen in FIGS. 1–3 wherein a wide part of the lip portion 24 adjacent to the front portion 8 of the headgear 4 is substantially more pronounced that at other locations. Most preferably, the wide part of the lip portion 24 extends far enough to accommodate not only the display graphics 34 required on the packaging system 2, but also a cavity (described below) for carrying additional printed material such as instruction booklets, extra sizing pads and/or other items. Preferably, the wide part of the lip portion 24 is also large enough to be formed with an aperture 36 to allow the headgear and packaging system to be mounted on a display hook. For example, whereas the lip portion 24 might extend as little as ½" at the lateral portions 12/14 and the rear portion 10 of the headgear 4, it could extend about 3" at the forward portion 8. Many other dimensional combinations could also be used.

The display graphics 34 can be applied in many ways to the lip portion 24. For example, the required information could be printed directly onto the lip portion 24, which as described in more detail below, is preferably formed as part of a molded plastic sheet. Alternatively, the display graphics 34 could be printed on a stick-on label, a cardboard sheet, or other suitable medium (not shown) that is mounted to either the front or back side of the lip portion 24. If the medium bearing the graphics 34 is attached to the back side of the lip portion 24, the latter is then preferably made from clear plastic so that the display graphics 34 will be visible on the front side of the lip portion 24, which is the side that will ordinarily face customers.

If it is desired to accommodate additional printed material, extra sizing pads, and/or other items on the lip portion 24, a cavity 38 (see FIG. 3) can be formed in the molded plastic sheet that forms this portion, opening on either side thereof. The materials placed in the cavity 38 can be removably secured therein by a cover 40, made of clear plastic or any other suitable material, that encloses the cavity 38 and which can be held in place in any appropriate fashion. For example, as shown in FIG. 3, the cover 40 can be a discrete element that is secured over the cavity 38, as by a snap or tab/groove or similar positioning device (not shown). Alternatively, the cover 40 could be formed as an extension of the lip portion 24 that folds over the cavity 38 via a living hinge or the like (not shown). In a still further alternative, the cover 40 could be configured as a small cardboard sheet or other non-plastic medium and could be attached over the cavity 38 with hot-melt glue or any other suitable affixing method. In yet another alternative, a larger covering (not shown) could extend over the entire upper surface of the headgear 4, as well as the cavity 38. This covering would then be vacuum-formed to the shape of the upper part of the helmet. In any of the foregoing constructions, the cover 40 could be printed with or otherwise carry the display graphics 34.

In accordance with the preferred embodiment of the invention, manufacture of the packaging system 2 described herein can be accomplished as follows: Using a mold of the lower portion of the headgear 4 to define the headgear engagement portion 20, a thin sheet of thermoplastic material can be vacuum-formed in the shape of the headgear lower rim 16 and vicinity, extending upwardly on the outside of the headgear 4 (to form the outer wall 28 of the headgear engagement portion 20) approximately to the parting line of the headgear liner 32 and with sufficient molding backdraft 29 to form a pressure fit of the headgear 4 into the molded plastic. The lip portion 24 formed by the remaining, outwardly extending planar areas of the thermoplastic material sheet is left around this molded portion. The center of the molded portion that corresponds to the inside of the headgear (shown by the dashed line 42 in FIG. 3) is trimmed away to leave a ring of molded plastic with the opening portion 22 and inner wall 26 at its center, and the lip portion 24 disposed around the opening portion 22. The aperture 36, possibly formed with a reinforcing grommet (not shown), can then be positioned at the center of the outermost edge of the wide part of the lip portion 24.

When the headgear 4 is ready for packaging, the headgear lower rim 16 is pressed into the trimmed molded portion of the thermoplastic material sheet, where it is held by the gripping force applied by the inner wall 26 toward the outer wall 28 of the headgear engagement portion 20. To be adequate, the gripping force should be sufficient to retain the headgear 4 in engagement with the engagement portion 20 during point-of-purchase display and customer handling of the headgear. Following purchase, however, a firm separating force applied by the customer to the headgear 4 and the headgear engagement portion 20 should be sufficient to release the two from their mutual engagement. Because the center of the molded portion has been trimmed to form the opening portion 22, the headgear interior 18 can be accessed directly by a potential wearer. In this manner, the customer can take the headgear 4 from the display peg 6 (or a store shelf) and try it on to see if it fits, without disturbing the packaging system 2. As previously stated, there is no need to remove the headgear 4 from the packaging system 2.

The headgear 4 can be displayed easily on store shelves by simply hanging it from the display peg 6, thereby utilizing shelf space more efficiently than with box packaging. Also, multiple units of the headgear 4 can be stacked for shipping (or display), with the back side of one packaging system 2 resting on the upper surface of the next lower headgear 4. This uses available space more efficiently than box packages. It will be further appreciated that the molded plastic used to form the packaging system 2 protects the headgear lower rim 16 of the next higher headgear 4. In bicycle and other recreational helmets, this area is typically formed as part of the EPS liner 32 and is normally exposed to contact with other objects, thus subjecting the area to damage such as dents and scratches.

To accommodate the retention straps and buckles usually associated with headgear, a suitable bundling retainer (not shown), such as a rubber band, could be used to wrap these items as tightly as possible. The items could then be located inside the headgear so that they do not dangle if the headgear is not properly situated for stacking and shipping. Alternatively, it may be possible to mold a second cavity in the packaging system 2 for storage of the straps and buckles.

Accordingly, a headgear packaging system for point-of-purchase display of headgear has been described that eliminates the disadvantages of prior art box packages. In addition to allowing customers to try on the headgear without removing it from the packaging system, the invention allows more efficient bulk packaging and headgear storage by reducing the space required between such products. The invention also eliminates the problem of damaged and incorrectly used boxes on store shelves. While various embodiments of the invention have been disclosed it should be apparent that many variations and alternative embodiments will be apparent to those skilled in the art in view of the teachings herein. It is understood, therefore, that the invention is not to be in any way limited except in accordance with the spirit of the appended claims and their equivalents.

What is claimed is:

1. A headgear packaging system for use with headgear, the headgear having a forward portion, a rearward portion, two lateral portions, a lower rim, a headgear interior, and a headgear exterior, said packaging system comprising:

a headgear engaging element engaging said headgear lower rim;

a central opening allowing access to said headgear interior;

a lip connected to said headgear engaging element and extending outwardly from said headgear; and whereby said central opening allows said headgear to be fitted on a wearer's head without removing said headgear packaging.

2. A headgear packaging system in accordance with claim 1 wherein said headgear engaging element comprises a trough.

3. A headgear packaging system in accordance with claim 2 wherein said trough is continuous and engages adjacent portions of said headgear lower rim.

4. A headgear packaging system in accordance with claim 3 wherein said central opening is defined by an inner wall of said trough.

5. A headgear packaging system in accordance with claim 4 wherein said inner wall of said trough terminates proximate to said headgear lower rim.

6. A headgear packaging system in accordance with claim 5 wherein said trough has an outer wall formed with a backdraft and extending to a location that is sufficiently distal from said headgear lower rim so that said outer wall helps retain said headgear packaging system on said headgear prior to purchase and use.

7. A headgear packaging system in accordance with claim 1 wherein said headgear includes an outer shell mounted on an inner liner, and wherein said trough outer wall terminates proximate to an edge of said outer shell.

8. A headgear packaging system in accordance with claim 1 wherein said lip extends continuously around said headgear lower rim.

9. A headgear packaging system in accordance with claim 1 wherein said lip is large enough adjacent to one side of said lower rim to receive display and other information relating to said headgear.

10. A headgear packaging system in accordance with claim 1 wherein said lip is formed with an aperture to allow said headgear to be mounted on a display peg.

11. A headgear packaging system in accordance with claim 1 wherein said lip is formed with a cavity for holding printed material such as instructions such as instruction booklets, extra sizing pads, and/or other items.

12. In combination with headgear having a forward portion, a rearward portion, two lateral portions, a lower rim and an upper crown, a headgear packaging system comprising:

a headgear engaging element engaging said headgear lower rim;

a central opening allowing access to said headgear interior;

a lip connected to and extending outwardly from said headgear; and whereby said central opening allows said headgear to be fitted on a wearer's head without removing said headgear packaging.

13. A combination in accordance with claim 12 wherein said headgear engaging element comprises a trough.

14. A combination in accordance with claim 13 wherein said trough is continuous and engages adjacent portions of said headgear lower rim.

15. A combination in accordance with claim 14 wherein said central opening is defined by an inner wall of said trough.

16. A combination in accordance with claim 15 wherein said inner wall of said trough terminates proximate to said headgear lower rim.

17. A combination in accordance with claim 16 wherein said trough has an outer wall formed with a backdraft and extending to a location that is sufficiently distal from said headgear lower rim so that said outer wall helps retain said headgear packaging system on said headgear prior to purchase and use.

18. A combination in accordance with claim 12 wherein said headgear includes an outer shell mounted on an inner liner, and wherein said trough outer wall terminates proximate to an edge of said outer shell.

19. A combination in accordance with claim 18 wherein said lip extends continuously around said headgear lower rim.

20. A combination in accordance with claim 12 wherein said lip is large enough adjacent to one side of said lower rim to receive display graphics relating to said headgear.

21. A combination in accordance with claim 12 wherein said lip is formed with an aperture to allow said headgear to be mounted on a display peg.

22. A combination in accordance with claim 12 wherein said lip is formed with a cavity for holding printed material such as instructions such as instruction booklets extra sizing pads, and/or other items.

23. A headgear packaging system for point-of-purchase display of a headgear, comprising:

a headgear engagement portion for engaging a headgear:

an opening portion allowing substantially unhindered access to interior portions of the headgear so that the headgear can be fitted on the prospective wearer's head prior to purchase; and a lip portion connected to said engagement portion.

* * * * *